US005558417A

United States Patent [19]

Termotto

[11] Patent Number: 5,558,417

[45] Date of Patent: Sep. 24, 1996

[54] CAROUSEL CABINET

[76] Inventor: Clara M. Termotto, 22 Wood Creek Dr., Pittsford, N.Y. 14534

[21] Appl. No.: 354,655

[22] Filed: Dec. 13, 1994

[51] Int. Cl.[6] ..... A47B 88/00; A47B 49/00

[52] U.S. Cl. ..... 312/249.9; 108/94; 312/249.7; 312/305; 312/125; 312/135

[58] Field of Search ..... 312/249.2, 249.4, 312/249.5, 249.9, 305, 307, 125, 135, 97.1; 108/94; 248/131

[56] References Cited

U.S. PATENT DOCUMENTS

| | | | |
|---|---|---|---|
| 59,341 | 11/1866 | Barrett . | |
| 226,995 | 4/1880 | Gold . | |
| 369,044 | 8/1887 | Cleary | 248/131 X |
| 655,275 | 8/1900 | Roth | 312/249.2 X |
| 673,755 | 5/1901 | Brown | 312/249.4 |
| 727,586 | 5/1903 | Chaffin | 312/249.4 |
| 944,158 | 12/1909 | Smith . | |
| 996,875 | 7/1911 | Morrison | 312/249.4 |
| 1,029,709 | 6/1912 | Norrlander | 312/249.4 |
| 1,242,235 | 10/1917 | Polk | 312/249.2 |
| 1,249,706 | 12/1917 | Zimmerman | 108/94 X |
| 1,464,890 | 12/1919 | Swain | 312/249.2 |
| 1,686,291 | 10/1928 | Moore | 312/125 X |
| 1,926,166 | 9/1933 | Nahon | 312/249.2 |
| 2,047,516 | 7/1936 | Lutsche | 312/249.2 |
| 3,860,307 | 1/1975 | Fostel | 312/249.4 |
| 4,225,201 | 9/1980 | Davis | 312/125 |
| 4,796,960 | 1/1989 | Candelas | 312/249.2 X |

*Primary Examiner*—Peter M. Cuomo
*Assistant Examiner*—Robert J. Sandy
*Attorney, Agent, or Firm*—Cumpston & Shaw

[57] ABSTRACT

A carousel cabinet including a base; a first, rotatable body section having at least one row and two colunms of drawers; a second, stationary body section having a flat top surface and including a light switch; a central, tubular shaft extending from the base to above the flat top surface and terminating in a light connected to the switch; a multiple electrical connector located in the second body section; and a single electrical connector operably connected to the multiple connector, located in the base, for supplying power to the multiple connector via connection to a standard extension cord. In addition, the second section may contain a variety of communications devices such as an intercom, a remote station call button, and so on, for sending and receiving a communication signal. The cabinet body may be cylindrical or of any other geometric shape that provides access to the drawers or open compartments therein by rotating the first body section. The base may be equipped with castors for mobilizing the cabinet. The cabinet is particularly suited to use by a bed ridden, or other similarly immobilized person.

20 Claims, 3 Drawing Sheets

CAROUSEL CABINET

BACKGROUND OF THE INVENTION

The invention relates to a carousel cabinet, and more particularly to a carousel cabinet for use by a bedridden or otherwise similarly immobilized person.

It is often difficult for a person who is bedridden, or otherwise partially immobilized, for example, to conveniently access a structure providing storage for items such as jewelry, cosmetics, articles of clothing, books, and so on, and a light for reading or other purposes having a control switch easily within reach. Although a table can be positioned next to the bed or chair of the immobilized person, a surface of the table and one or two sides, at most, will be within reach. The top of the table may freely support a lamp; however, it can be unintentionally displaced from the structure, and the switch for the lamp must be located within reach of the person which limits both the design and location of the lamp. The presence of, and preference for, other external devices like a portable radio or clock, for instance, may rob other items of limited surface space on the table.

In view of the constraints identified above, and others, imposed upon the intended user, the inventor has recognized a need for a structure that alleviates these obstacles and inconveniences to quality of life, and that is accessible by the person without external assistance.

SUMMARY OF THE INVENTION

It is an object of the invention to provide a carousel cabinet for use by a person who is bedridden or otherwise similarly immobilized, that is easily accessible from a bedside; that provides adequate and accessible storage space; that provides an accessible, flat surface for setting items on; and that can provide localized illumination which is stable and controllably within reach of the user.

It is another object of the invention to provide a carousel cabinet as described that additionally can be equipped with communication devices such as a radio and/or a remote station call button, intercom, or other devices for communicating with a remote location.

In accordance with these objects, a carousel cabinet comprises a vertically oriented, elongate body comprising a first section including a plurality of compartments adjacent a periphery of the body, rotatable about a longitudinal axis of the body, and a second section having a flat top surface, located immediately adjacent and above the first section, wherein the second section is stationary with respect to the first section, the body further having a central longitudinal bore; a base operably connected to the first section of the body and located adjacent and below the first section; a tubular shaft passing through the central bore in the body and having one end terminating in the base and another end terminating between about six to twenty four inches above the flat surface of the second section of the body; illumination means connected with the other end of the shaft for providing light in an area of the cabinet; a switch operably connected to the illumination means mounted in a face of the second section; and electrical connection means for providing electrical power delivery to the second section.

In a preferred embodiment, the electrical connection means for providing electrical power delivery to the second section of the cabinet includes a multiple electrical connector located in the second section of the cabinet that is connected via a power cord running through the conduit that terminates in a single electrical connector located in the base of the cabinet, which can be connected to a conventional electrical outlet by a standard extension cord. The light switch is connected to the multiple electrical connector in the second section.

In an aspect of the preferred embodiment of the invention, the second section has sufficient interior space for housing any one or a plurality of communication devices such as a remote station call button, and intercom, a radio, a clock and so on, that are mounted therein and are functionally accessible to the user at the periphery of the second section. Each of the devices requiring electrical power are connectable to the multiple electrical connector located in the second section. An access door in the second section is provided to allow access therein.

The invention, along with the objects and advantages thereof, will be explained in greater detail with reference to the figures and the description which follow.

BRIEF DESCRIPTION OF THE DRAWINGS

FIG. 2*b* is a top plan view of an alternative embodiment in which a drawer opens and closes by pivot action.

DETAILED DESCRIPTION OF THE PREFERRED EMBODIMENT

Figure 1:
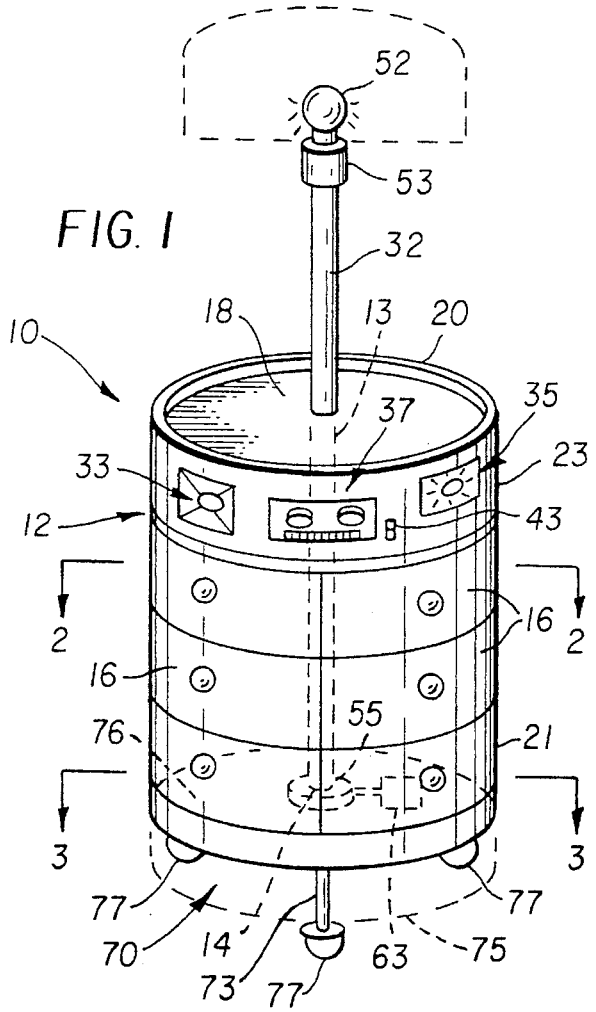
FIG. 1 is a schematic perspective view of a preferred embodiment the cabinet.

A presently preferred embodiment of the invention is illustrated in FIG. 1. The carousel cabinet 10 includes a main body 12 composed of a first section 21 and a second section 23. The body 12 is vertically elongate as shown, and has a central longitudinal bore 13 as shown in phantom in FIG. 1. The bore in the first body section 21 is occupied by axle and bearing hardware 14 well known to those skilled in the art, that allows the first section of the body to rotate about a tubular shaft 32 that is collinear with the longitudinal axis of the body, and which will be further described below.

Figure 2A:
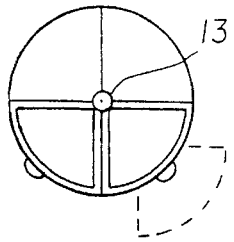
FIGS. 2*a* through 2*e* are top, plan views of the body of the cabinet through line 2—2 of FIG. 1.

In an aspect of this embodiment, the cabinet 10 has a circular cross section as shown in FIG. 2*a* to impart an overall cylindrical shape to the cabinet. The cabinet, however, can likewise have other geometric cross sectional shapes as shown in FIG. 2*b*–2*e*; the primary consideration being accessibility to all of the faces of the first body section 21 by rotation of the first section.

Figure 2B:
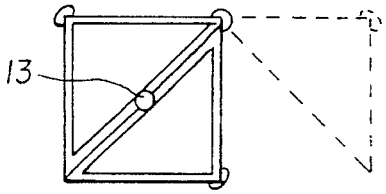
Figure 2C:
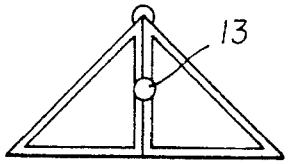

The first section 21 of the body 12 further includes a plurality of compartments 16 that, preferably, are in the form of slidable drawers as shown in FIGS. 1 and 2*a*. The face of each drawer defines the periphery of the first section of the body. Each drawer 16 has a cross sectional shape that allows at least two drawers to occupy the same vertical position in the first section of the body; i.e. a row of at least two drawers. Each of the drawers is supported in the body by structure well understood to those skilled in the art that allows each drawer to conventionally slide in and out of the body. It will be appreciated, in the alternative, that the drawers could be pivoted at a peripheral location of the body, as shown in FIG. 2*b*, allowing each of the drawers to swing in and out of the body for access, as opposed to the linear sliding motion described above. For example, in a square cross sectional cabinet, each of two drawers in a row having faces forming two sides of the square body could be pivoted at a common corner, or diagonally opposing corners, of the body allowing the drawers to swing between an open and shut position.

Multiple rows of drawers are provided in the first section of the body as shown in FIG. 1, giving the appearance of a row by column arrangement of the drawers. This arrangement, however, does not limit the drawers to a single height so that a column of drawers may contain a drawer having a height different than the height of the drawer in an adjacent column. Preferably, drawer height will be in multiples of the smallest vertically dimensioned drawer to give the cabinet a uniform appearance.

In another aspect, some or all of the compartments can be open-faced, as opposed to drawers, for unimpeded access thereto.

The second section 23 of the body 12 is identical in cross sectional shape to the first section, and is located immediately above the first section 21 to give an appearance of continuity to the body. The second section is stationary, that is, it does not rotate. The second section includes a top surface 18 that is flat and that serves as a conventional table top surface with the exception of the central shaft 32 extending therethrough. In an aspect of the invention, a sufficiently high rim, or lip 20, encircles the peripheral edge of the flat surface 18 to prevent items from falling off the edge of the surface. A switch 43 for a light (described below) is mounted in a side face of the second section.

Figure 5:
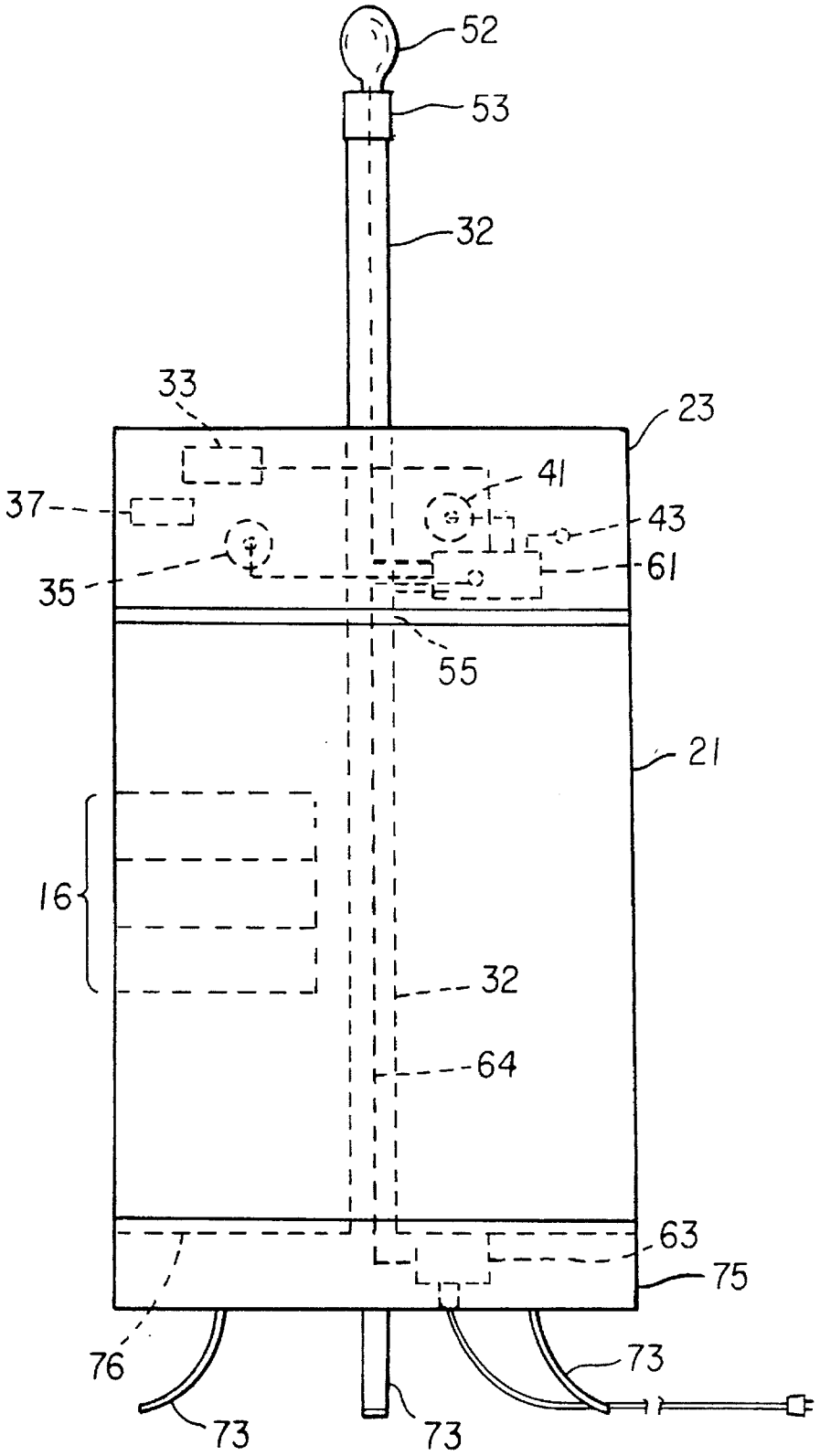
FIG. 5 is a rear view of the body of the cabinet.

The second section 23 has a hollow interior, as shown in FIG. 5, that is sufficient in size to house any of a variety of communications and/or entertainment devices allowing passive or active communication with a remote location. For example, a call button device 33 may be installed in the second section that is operably connected to a remote location for sending a signal that assistance is required. Alternatively, or in addition, a microphone and receiver 35 (intercom system) may be installed in the second section for verbal communication between the user and a remote location. Furthermore, a telephone connection may be part of the equipment housed in the stationary part of the body, as could a radio 37, clock 41 and/or a small television. Any portions of any of these devices requiring externalization are mounted in the face of the second section for access by the user. The details of each of the devices mentioned are well known to those skilled in the art and do not require further discussion herein.

A cabinet base 70 is located immediately below the first section 21 of the body for support. In a preferred aspect of the embodiment, the base 70 includes a flat support surface 76 for supporting the body rotation hardware and a plurality of legs 73 depending therefrom. A skirt 75 depends from the periphery of the flat support surface of the base to hide the appearance of an electrical connector 63 attached to the underside of the support surface, which will be further described below.

Figure 3A:
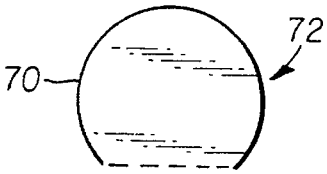
FIGS. 3*a* through 3*c* are top, plan views of an alternative form of the base of the cabinet, corresponding to the cross sectional cabinet shapes in FIGS. 2*a*–2*c*.
Figure 3B:
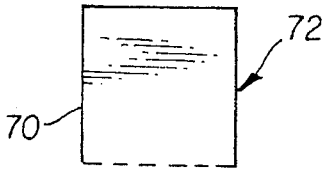
Figure 2D:
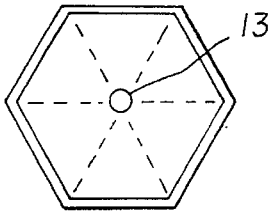
Figure 3C:
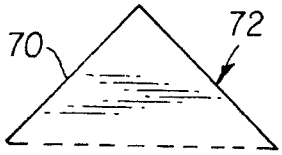
Figure 2E:
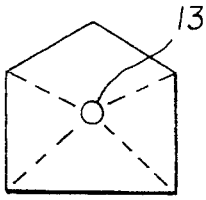
Figure 4:
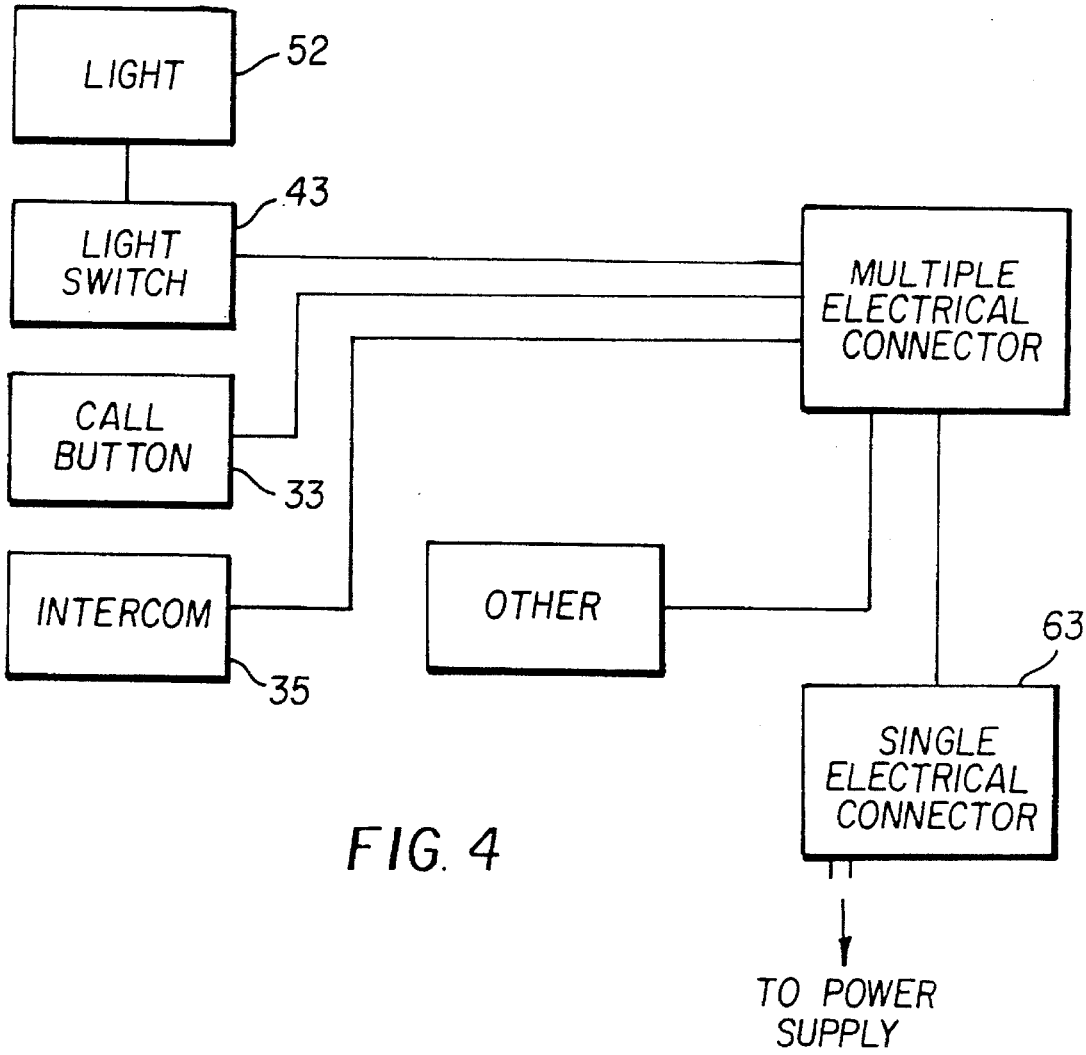
FIG. 4 is a diagrammatic block diagram of the connection between electrically powered components of the cabinet and a junction box for connection to a standard electrical outlet by an extension cord.

In another aspect of the invention, the base 70 includes solid sidewalls 72 and has a cross sectional shape identical to that of the body, as shown in FIG. 3, to give the cabinet 10 an appearance of continuity. This aspect of the base can contain storage space therein and access to this space through a removable side wall panel or door.

Each aspect of the base of the invention can be suitably equipped with castors 77 or rollers to give the cabinet mobility.

As shown in FIG. 1, a central, longitudinal, tubular shaft 32 extends up from the base 70 through the central bore 13 of the body 12 and terminates in a housing 53 for a lighting device 52 positioned between about 6–24 inches above the flat surface 18 of the second section 23 of the body, the distance being selected to provide a comfortable illumination profile. The shaft 32 provides alignment and support to the base and body components of the cabinet, a structure for supporting the lighting device 52 and a conduit for wiring to carry power to the light switch 43 and any optional devices requiring electrical power. The shaft 32 has openings 55 at appropriate locations along its length for the passage of wiring within the cabinet.

In order to supply power to the light switch and other electrically powered appliances located in the second section of the body, a single electrical connector 63, such as a male electrical plug, is located in the base 70 of the cabinet. One end of a standard electrical extension cord can be connected to the plug and the other end connected to a standard electrical outlet. A power cord 64 connects the single electrical connector 63 to a multiple electrical connector 61 located within the second section of the cabinet. The length of the cord 64 utilizes the hollow tubular shaft 32 as a conduit and exits the shaft 32 in the second section of the cabinet through the opening 55 in the shaft at the appropriate location. The multiple electrical connector 61 in the second section of the body can be equipped with female electrical receptacles or hardwire capability, to provide connections to the light switch and any other electrically powered devices located in the second section of the cabinet. It will be appreciated that the hollow tubular shaft 32 also acts as a conduit for the wire running from the lighting device 52 to the light switch 43.

In a preferred embodiment, the body 12 of the cabinet will have an elongate dimension sufficient to position the top surface of the second section at a height that makes it accessible to a person sitting in a bed or in other similar, semi-confined environments. Thus, the top surface of the body is located in the range of about 30 inches to 48 inches above the floor level. Accordingly, the second section 23 of the body will have a height of between about 6–12 inches, but these dimensions are not limiting features of the invention.

While the invention has been described in connection with the presently preferred embodiment thereof, those skilled in the art will recognize certain modifications and changes may be made therein, without departing from the true spirit and scope of the invention which is intended to be limited solely by the appended claims.

I claim:

1. A carousel cabinet, comprising:

an elongate body comprising a first section including a plurality of compartments adjacent a periphery of the body, rotatable about a longitudinal axis of the body, and a stationary second section having a flat top surface, located immediately adjacent and above the first section, wherein the first section is rotatable with respect to the stationary second section, the body further having a central longitudinal bore;

a base connected to the first section of the body and located adjacent and below the first section;

a tubular shaft passing through the central bore in the body and having one end terminating in the base and another end terminating between about six to twenty four inches above the flat top surface of the stationary second section of the body, the shaft connecting the base with the stationary second section, the first section being rotatable with respect to the base and stationary second section, illumination means connected with the other end of the shaft for providing light in an area of the cabinet;

a switch connected with the end above the flat top surface of the stationary second section;

electrical connection means for providing electrical power delivery to the second section; and communication device means located in the stationary second section of the body for sending and/or receiving a communication signal.

2. The carousel cabinet of claim 1 in which the body has one of a circular and a symmetrical geometric cross sectional shape.

3. The carousel cabinet of claim 1 in which the plurality of compartments are arranged in a row by column configuration around the periphery of the first section of the body.

4. The carousel cabinet of claim 1 in which the plurality of compartments includes at least two drawers.

5. The carousel cabinet of claim 4 in which the at least two drawers slidably engage the body.

6. The carousel cabinet of claim 4 in which the at least two drawers pivotally engage the body.

7. The carousel cabinet of claim 1 in which the plurality of compartments have a plurality of sizes.

8. The carousel cabinet of claim 1 in which the base includes a flat support surface and a plurality of legs depending therefrom.

9. The carousel cabinet of claim 1 including mobilizing means attached to the base.

10. The carousel cabinet of claim 2 in which the base has a cross sectional shape corresponding to the cross sectional shape of the body.

11. The carousel cabinet of claim 1 further including a lip depending from a periphery of the flat, top surface of the second section.

12. The carousel cabinet of claim 1 in which the electrical connection means includes a multiple electrical connector located within the second section of the body and a single electrical connector located in the base and operably connected to the multiple electrical connector via a conduit, whereby electrical power supplied to the single electrical connector is transferred to the multiple electrical connector.

13. The carousel cabinet of claim 8 in which a skirt depends from a periphery of the flat support surface for a sufficient distance to hide the appearance of a electrical connector.

14. The carousel cabinet of claim 1 in which the shaft includes an opening along its length for the entrance and exit of a power supply wire.

15. The carousel cabinet of claim 1 including communication device means located in the second section of the body for sending and/or receiving a communication signal.

16. The carousel cabinet of claim 1 in which the communication device means is a remote station call button.

17. The carousel cabinet of claim 1 in which the communication device means is an intercom device.

18. The carousel cabinet of claim 1 in which the communication device means is a clock.

19. The carousel cabinet of claim 1 in which the communication device means is a telephone receptacle.

20. The carousel cabinet of claim 1 in which the communication device means is a radio.

* * * * *